US009289065B1

(12) United States Patent
Lambertson

(10) Patent No.: US 9,289,065 B1
(45) Date of Patent: Mar. 22, 2016

(54) ELONGATE MEMBERS SHELF WITH ADJUSTABLE BRACKETS

(71) Applicant: Ted Lambertson, Zephyr Cove, NV (US)

(72) Inventor: Ted Lambertson, Zephyr Cove, NV (US)

( * ) Notice: Subject to any disclaimer, the term of this patent is extended or adjusted under 35 U.S.C. 154(b) by 0 days.

(21) Appl. No.: 14/495,647

(22) Filed: Sep. 24, 2014

Related U.S. Application Data

(60) Provisional application No. 61/882,253, filed on Sep. 25, 2013.

(51) Int. Cl.
*A47B 96/06* (2006.01)
*A47B 96/02* (2006.01)

(52) U.S. Cl.
CPC ..... *A47B 96/027* (2013.01); *A47B 96/061* (2013.01)

(58) Field of Classification Search
CPC .. A47B 96/027; A47B 96/028; A47B 96/061; A47B 96/067; A47B 96/1441; A47F 5/0838; A47F 5/0846; A47G 25/0692; A47K 10/04
USPC ..... 211/87.01, 70.4; 248/250, 255, 68.1; 108/152; D8/373, 376
See application file for complete search history.

(56) References Cited

U.S. PATENT DOCUMENTS

| | | | | | |
|---|---|---|---|---|---|
| 275,481 | A | * | 4/1883 | Gould | 248/265 |
| 1,067,850 | A | * | 7/1913 | Warner | 248/250 |
| 1,176,588 | A | * | 3/1916 | Miller et al. | 248/250 |
| 1,677,764 | A | * | 7/1928 | Gloekler | 193/38 |
| 1,947,369 | A | | 2/1934 | Witzleb | |
| 2,859,879 | A | | 11/1958 | Rogers et al. | |
| 2,973,869 | A | * | 3/1961 | Raymond | 108/5 |
| 3,233,852 | A | * | 2/1966 | Azar | 248/68.1 |
| D214,923 | S | * | 8/1969 | Schler et al. | D6/566 |
| 4,150,753 | A | * | 4/1979 | Stahl et al. | 211/105.1 |
| 4,316,546 | A | * | 2/1982 | Varon et al. | 211/105.1 |
| 4,455,007 | A | * | 6/1984 | Varon et al. | 248/251 |
| 4,874,148 | A | * | 10/1989 | Guinter | 248/220.22 |
| 5,253,837 | A | | 10/1993 | Loux | |
| 5,318,174 | A | * | 6/1994 | Zoroufy | 211/45 |
| 5,398,824 | A | * | 3/1995 | Wolff et al. | 211/88.04 |
| 5,584,404 | A | * | 12/1996 | Tsai | 211/94.01 |
| 6,257,425 | B1 | * | 7/2001 | Liu | 211/90.01 |
| 6,561,364 | B1 | * | 5/2003 | Brunsden | 211/90.01 |
| 6,786,337 | B2 | * | 9/2004 | Klein et al. | 211/34 |
| 7,150,364 | B2 | * | 12/2006 | Jablow et al. | 211/153 |
| 7,438,268 | B2 | * | 10/2008 | Kologe | 248/220.22 |
| 2007/0200039 | A1 | | 8/2007 | Petak | |
| 2009/0223912 | A1 | * | 9/2009 | Chen | 211/48 |

* cited by examiner

*Primary Examiner* — Joshua Rodden
(74) *Attorney, Agent, or Firm* — Kenehan & Lambertsen, Ltd; John C. Lambertsen

(57) ABSTRACT

A shelf assembly is constructed of elongate members and adjustable supporting brackets. The elongate members are received within aligned pairs of apertures formed in the supporting brackets in a manner restricting the vertical movement of the elongate members. Adjustable set screws extend into each of the apertures, selectively engaging the received elongate members and preventing their inadvertent removal.

11 Claims, 4 Drawing Sheets

ELONGATE MEMBERS SHELF WITH ADJUSTABLE BRACKETS

RELATED APPLICATIONS

The present application claims the benefit of priority under 35 USC §119(e) to U.S. Provisional Application No. 61/882,253, filed on Sep. 25, 2013, which is incorporated by reference herein for all that it contains.

BACKGROUND OF THE INVENTION

1. Field of the Invention

The present invention relates to support structures and, more particularly, to shelf assemblies. More specifically, the present invention relates to shelf assemblies having multiple support brackets and elongated members.

2. Description of the Related Art

The heavy use and hygienic requirements of commercial kitchens have resulted in using construction materials that provide durability and that are easy to clean. The majority of western restaurant kitchens have fiberglass reinforced plastic walls and floors, with stainless steel used for most other surfaces, such as work areas and door and drawer fronts. Storage areas and shelving in and adjacent to work areas also heavily rely upon stainless steel for its durability and being easy to clean. Stainless steel also offers corrosion resistance, an important benefit in the warm and moist environment existing in most commercial kitchens.

As presently designed, commercial stainless steel shelving utilizes several longitudinal tubes welded to support brackets. Shipped as finished units, the processes required to weld and polish the tubing are both time and labor intensive. Such fabrication limits installation to new construction projects, since the position of the welded brackets is fixed relative to the shelving tubes—and relative to the supporting wall.

Often used to support heavy loads, commercial stainless steel shelving requires adequate structural support. If the plan is for attachment to a wall, reinforcing backing of the wall is required. If such shelving is to be made a part of other stainless steel kitchen units, adequate supporting structures must be designed into those units. When additional shelving is desired, either of these design alternatives will require expensive remodeling efforts to accommodate the additional shelving. Rearranging existing shelving in response to changed requirements of a commercial kitchen can be cost-prohibitive.

SUMMARY OF THE INVENTION

A shelf constructed of elongate members is provided adjustable brackets in accordance with aspects of embodiments of the present invention provides enhanced installation choices. The adjustability of the brackets enables their attachment to wall studs. Great storage flexibility is also provided, with the installation of additional brackets easily accomplished when additional weight storage is required. No additional welding or polishing is required when attaching the new shelving pieces—nor must the prior shelving be removed from the premises to accomplish the modifications. Should site conditions require modification of shelving length, individual shelving tubes, bars, or the like can be easily trimmed to any required size without requiring re-fabrication of the entire shelf unit.

Such members are also appropriate for many residential uses and applications. The "stainless" look is considered desirable by many homeowners, and these tubes and bars can provide sturdy grab bars, towel racks, pot racks, and the like. Bars and tubes of different dimensions can be provided, depending upon the application. For example, towel racks may suggest the use of smaller tube diameters, such as ½-inch.

An aspect of embodiments in accordance with the present invention is a shelf assembly, comprising: a pair of supporting brackets, said pair of supporting brackets each having at least one lateral aperture formed therein, each at a corresponding extended location thereon; at least one cross rail extending between each of said pair of supporting brackets and slidably received by each of said pair of lateral apertures in a manner such that said cross rail is vertically captured within each of said lateral apertures; and a fastener received in each of said pair of supporting brackets, wherein each of said fasteners are in selective anchoring relation with said cross rail upon receipt of said cross rail within each of said lateral apertures.

Another aspect of embodiments in accordance with the present invention is a shelf assembled to spaced mounting brackets comprising: a pair of supporting brackets, each mounted to a separate one of a pair of mounting brackets in spaced relation to each other, each supporting bracket having at least one lateral aperture formed therein and generally aligned with the lateral aperture formed in said other supporting bracket; a corresponding number of cross rails extending between and received within each aligned pair of apertures, the configuration of said apertures and of said cross rails cooperative to vertically capture said cross rails within said apertures; and a plurality of fasteners selectively engageable with one of the cross rails in each of said aligned pairs of apertures to prevent inadvertent removal of said cross rails from said pair of supporting brackets.

A still further aspect of embodiments in accordance with the present invention is a bracket assembly for shelving comprising: a supporting bracket having at least one lateral aperture formed therein at an extend location thereon, each said lateral aperture configured to accept a cross rail in a manner such that said cross rail is vertically captured within said lateral aperture; and a corresponding number of fasteners selectively engageable with a cross rail received within each said lateral aperture to prevent inadvertent removal of said cross rail lateral aperture.

It is to be understood that the invention is not limited in its application to the details of construction and the arrangement of components described hereinafter and illustrated in the drawing figures. Those skilled in the art will recognize that various modifications can be made without departing from the scope of the invention.

These and other objects, aspects, and features of the present invention will be better understood from the following description of embodiments when read in conjunction with the appended drawing figures.

BRIEF DESCRIPTION OF THE DRAWINGS

Embodiments in accordance with the present invention are described below in connection with the accompanying drawing figures in which.

DETAILED DESCRIPTION OF THE PREFERRED EMBODIMENTS

Figure 1:
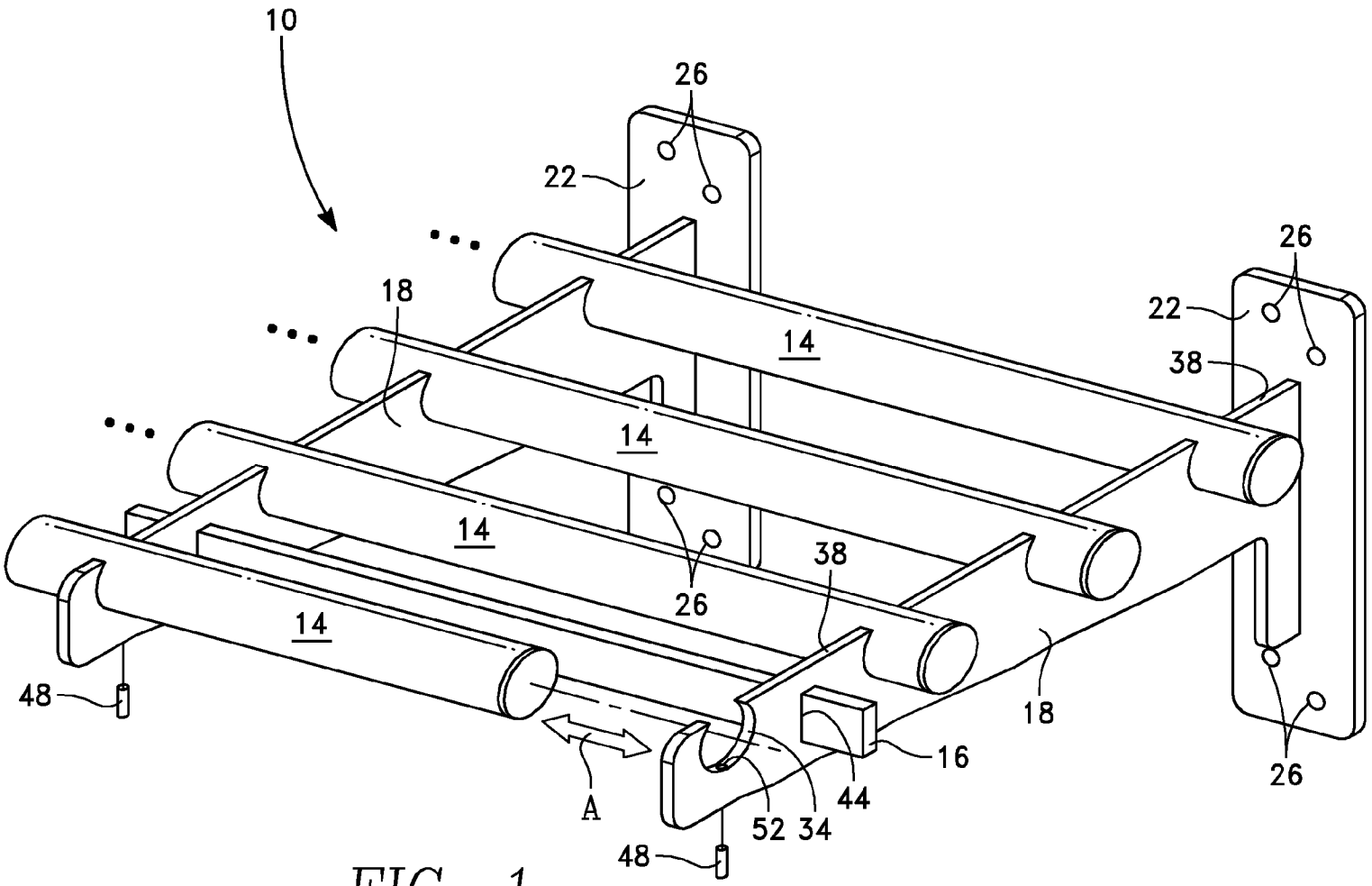
FIG. 1 is a partial perspective view, with portions shown exploded, of an elongate members shelf having adjustable brackets in accordance with the present invention.

Reference is now made to the drawings wherein like structures refer to like parts throughout. In FIG. 1, a shelf 10 includes a plurality of elongate round cross rails 14 and a single elongate bar cross rail 16, all received and supported by a plurality of supporting brackets 18, each of the supporting brackets 18 include a mounting bracket 22 for attachment to a support structure (not shown in the Figures) such as a re-enforced building wall or stand-alone shelving or pot racks. A plurality of fastener openings 26 are formed in each of the mounting brackets 22 for such attachment.

The elongate cross rail members—in the shelf 10 consisting of the plurality or elongate round cross rails 14 and the single elongate bar cross rail 16, are each received by an appropriately-sized cross rail aperture formed in a lateral location on each of the supporting brackets 18 at corresponding extended locations thereon. Two types of such apertures are provided—an open aperture lacking a continuous inner aperture wall, and a closed aperture wherein the aperture lies entirely within the supporting bracket 18.

Figure 3:
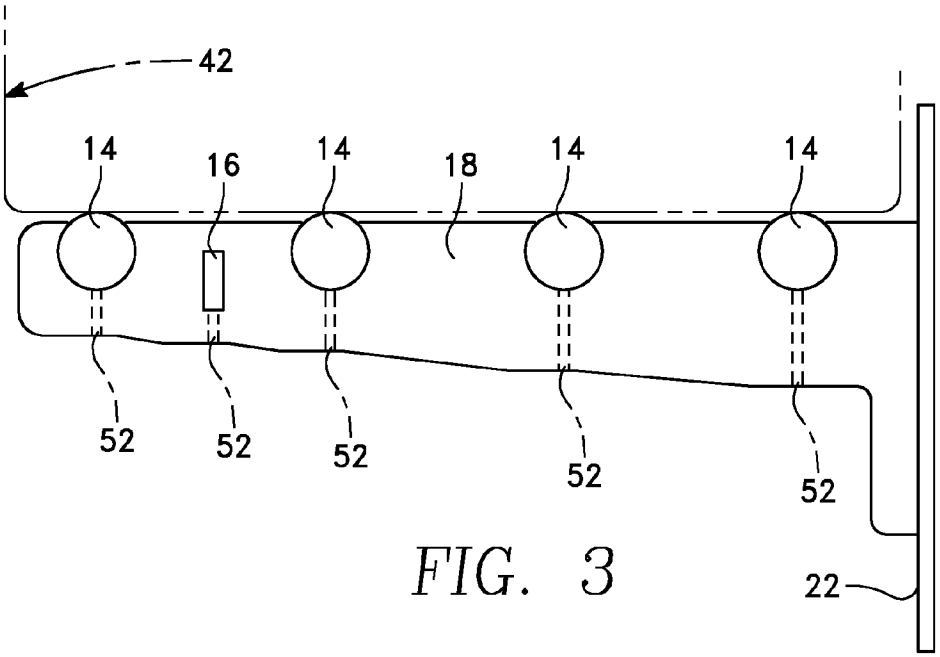
FIG. 3 is a side elevation view of the elongate members shelf of FIG. 1.
Figure 2:
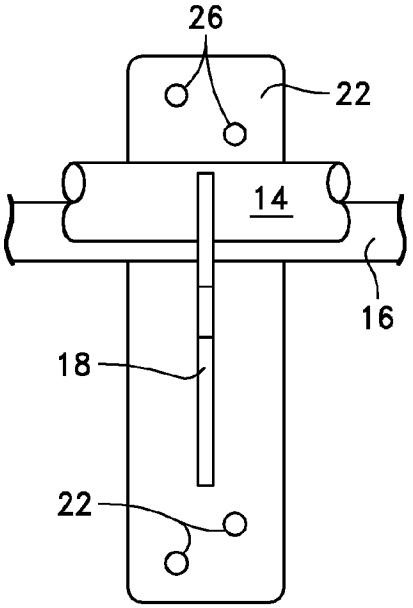
FIG. 2 is a front elevation view, with portions shown in phantom, of the elongate members shelf of FIG. 1.

As shown in the shelf 10 in FIG. 1, the plurality of elongate round cross rails 14 are each received by an open round aperture 34, permitting an upper surface of the elongate round cross rails 14 to project above an upper bracket surface 38 of the supporting bracket 18. FIGS. 2 and 3 show such a raised configuration of the plurality of round cross rails 14, which enables one or more stored items 42 placed thereupon (shown in phantom in FIG. 3) to freely slide without interference from the supporting brackets 18.

In a presently preferred embodiment the open round aperture 34 is configured to restrain vertical displacement of the elongate round cross rails 14 by presenting an opening in the upper bracket surface 38 that is smaller than the diameter of the elongate round cross rails 14. In this manner the round cross rails 14 is vertically captured by the supporting bracket 18 when received within the open round aperture 34. Installation of the elongate round cross rails 14 requires their lateral insertion into the open round aperture 34 as depicted by arrow A in FIG. 1.

The elongate bar cross rail 16 in FIG. 1 is received by a closed aperture 44 formed in each of the supporting brackets 18. In this configuration the pair of supporting brackets 18 function as a lateral "stop," preventing items hanging from, or supported by, the elongate bar cross rail 16 (none shown in the Figure) from easily sliding off either end. Installation of the elongate bar cross rail 16 within the supporting bracket 18 is preferably through lateral insertion into the closed aperture 44, in a similar manner as described above in the context of the elongate round cross rail 14 and the open round aperture 34.

Figure 4:
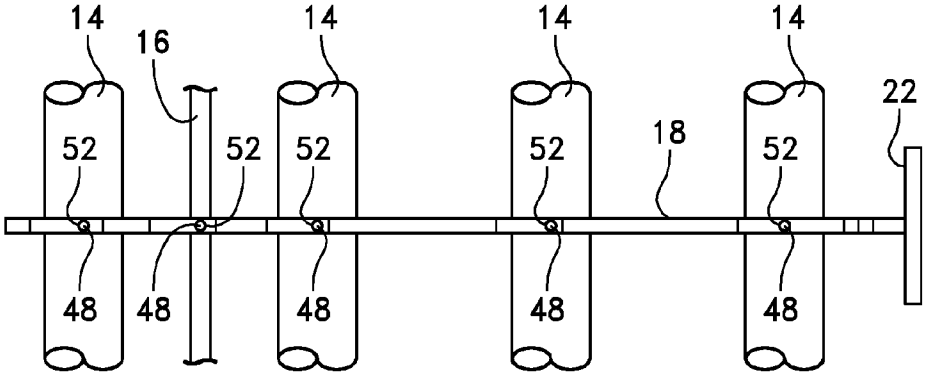
FIG. 4 is a bottom plan view of the elongate members shelf of FIG. 1.

With both the elongate round cross rails 14 and the elongate bar cross rails 16, once positioned relative to the supporting brackets 18 a set screw 48 is used to prevent lateral movement relative to the supporting brackets 18. The set screw 18 is received within a threaded hole 52 formed within the supporting bracket 18 adjacent to and opening in to each of the open round apertures 34 and the closed aperture 44. Tightening the set screw 48 against each of the elongate round cross rails 14 and each of the elongate bar cross rails 16, placing the set screw 48 in selective anchoring relation with the elongate round and bar cross rails 14, 16, maintains their desired lateral positioning relative to the supporting brackets 18 (also see FIG. 4).

Figure 5:
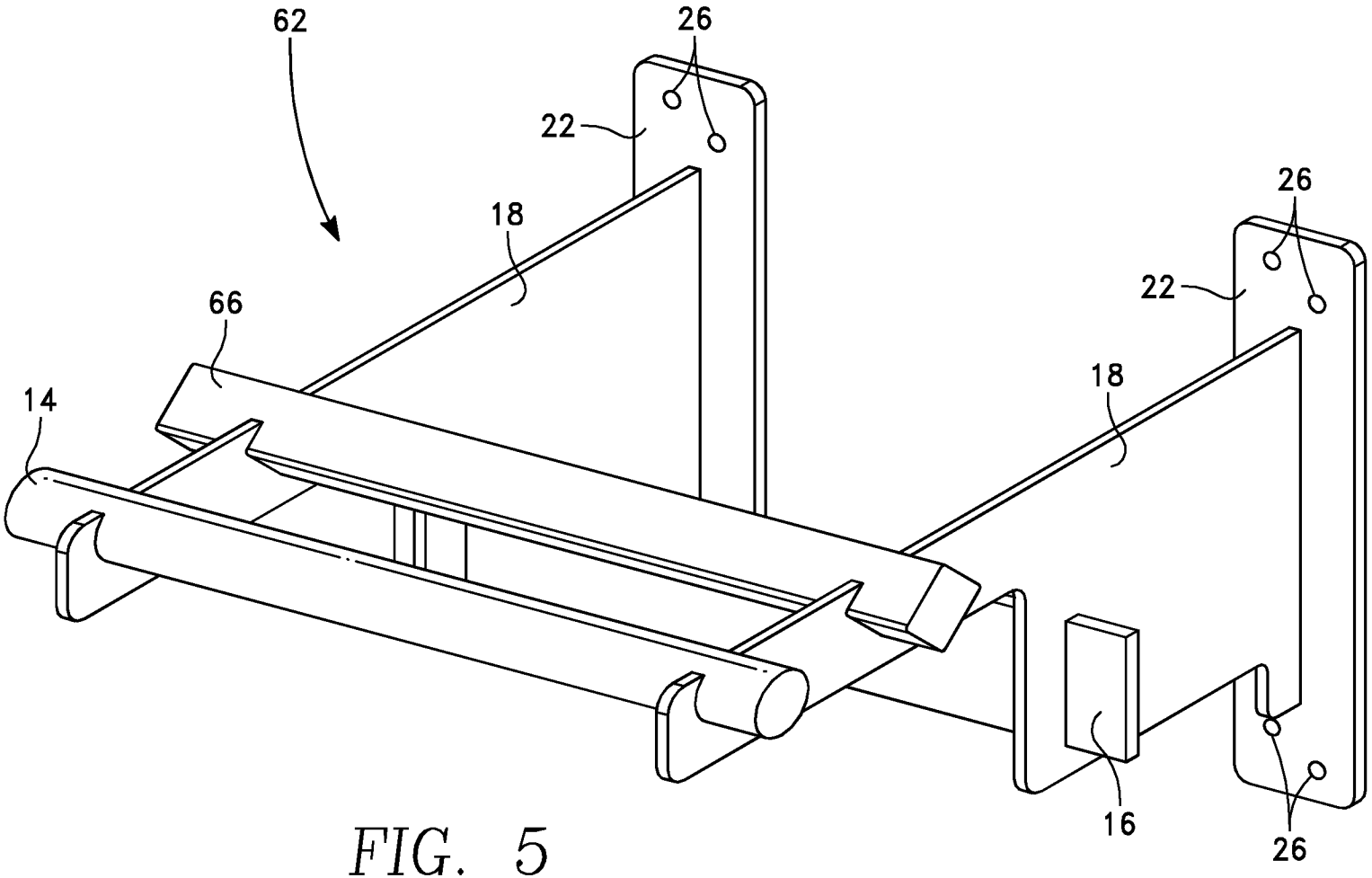
FIG. 5 is a perspective view of an elongate members shelf having adjustable brackets of alternative design in accordance with the present invention.

An alternative shelf 62 shown in FIG. 5 exemplifies the adaptability in shelf design accorded under the present invention. The supporting brackets 18 can be configured to accommodate multiple configurations and sizes of tubing, rods, and bar, including round, square, rectangular, octagonal, and so forth. Although the primary driver for such multiple configurations is cosmetic appeal, some shapes enable the use of optional accessories, such as hooks to hang various items. Besides receiving the elongate round cross rail 14 and the elongate bar cross rail 16, the alternative shelf 62 also makes use of an elongate square cross rail 66 that is supported by the pair of supporting brackets 18.

Figure 7:
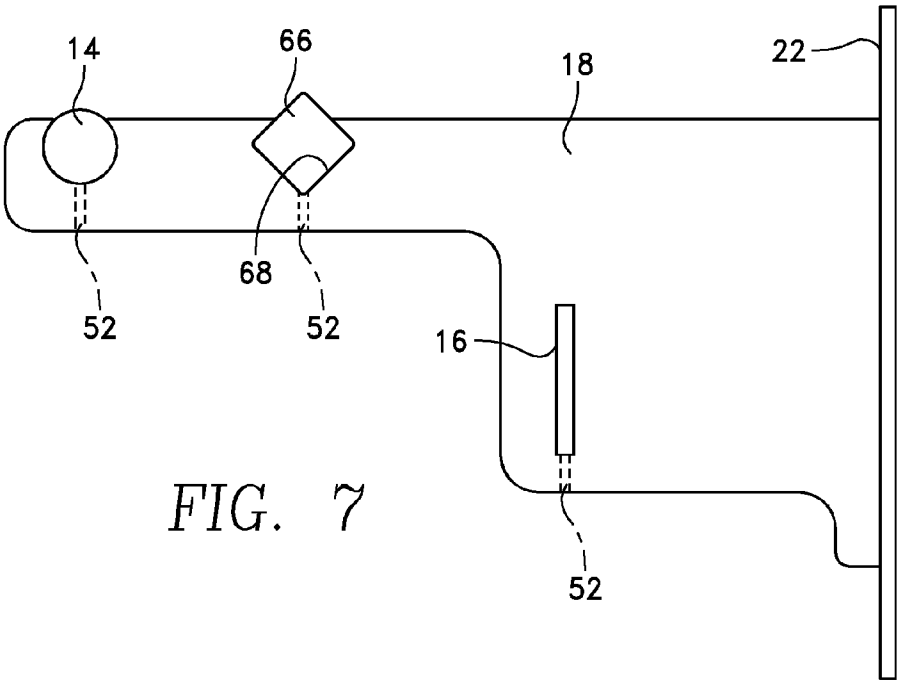
FIG. 7 is a side elevation view of the elongate members shelf of FIG. 5.
Figure 8:
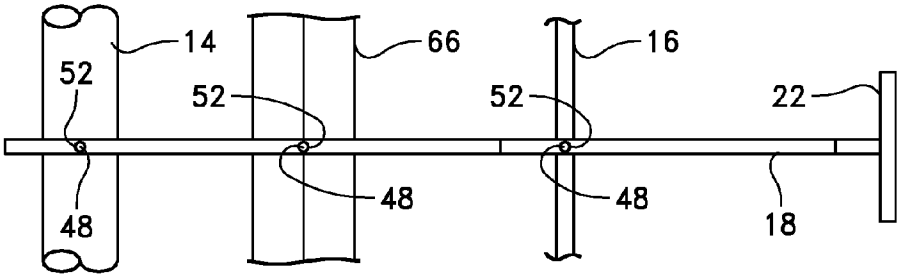
FIG. 8 is a bottom plan view of the elongate members shelf of FIG. 5.
Figure 6:
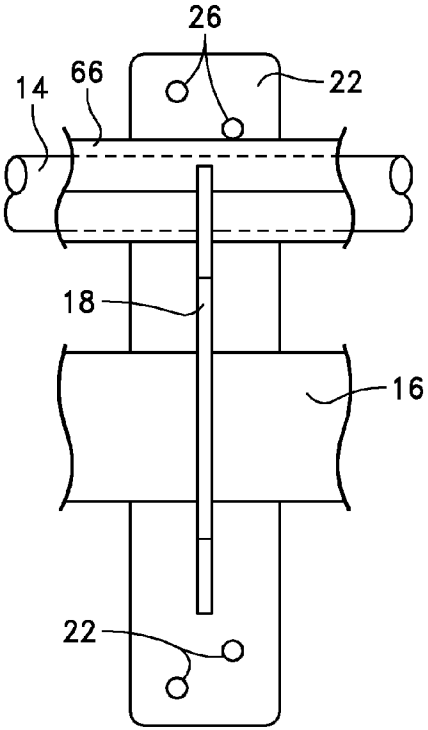
FIG. 6 is a front elevation view, with portions shown in phantom, of the elongate members shelf of FIG. 5.

Similar to the previous design, the alternative shelf 62 places the elongate square cross rail 66 within an open square aperture 68 (see FIG. 7) and the elongate round cross rail 14 within the open round aperture 34 to provide an elevated support surface for stored items (such items are not shown in FIG. 7). A plurality of set screws 48 (not shown) received with in a corresponding plurality of threaded holes 52 are utilized to restrain further lateral movements of the cross rail members once satisfactorily positioned relative to the support brackets 18 (see FIG. 8). As so constructed, no welding or polishing of the shelving rails is required. No top or upper-exposed fasteners enables multiple combined configurations, as in FIG. 5, and superior cleanability and a professional physical appearance.

The shelves of the present invention are preferably fabricated out of solid-plate steel, with the supporting and mounting brackets utilizing heavy-duty stainless steel plate of ¼-inch thickness, providing substantial strength and stability over the light 14-gauge material utilized in the weld-bracket construction. It is to be understood and appreciated that other metals can also be used, such as aluminum and steel that can be powder-coated to a desired color. Fabrication utilizes set screws with threaded holes formed in the bracket components of corresponding diameter. The elongate cross rails—round, square, etc., are preferably fabricated out of 0.048-0.075 gauge tubing or ⅛-½ inch bar stock, of varying lengths, depending upon the application. On-site length adjustments are also contemplated by the present invention, as previously discussed. The elongate bars can also vary in dimension to match the particular job requirements and adjusted on-site.

The design of the present inventive shelves can be tailored to specific, custom requirements, including specifications as to the desired shelf-loading capacity(ies). For typical applications reliance for support can be had by attachment to standard wall studs. Where heavier loads are anticipated, special supporting structures may be required.

My invention has been disclosed in terms of a preferred embodiment thereof, which provides an elongate members shelf having adjustable brackets that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. A shelf assembly, comprising:

a pair of supporting brackets, said pair of supporting brackets each having a plurality of lateral apertures formed therein, each at a corresponding extended location thereon, and wherein at least one of said plurality of apertures is an open aperture lacking a continuous inner aperture wall;

a plurality of cross rails extending between each of said pair of supporting brackets, at least one of said plurality of cross rails extending between each of said pair of supporting brackets and slidably received by said open apertures in a manner such that said at least one cross rail is vertically captured within each of said open apertures, wherein each of said open apertures is configured to restrain vertical displacement of said at least one of said plurality of cross rails by presenting an opening in an upper bracket surface of said supporting bracket that is smaller than the diameter of said at least one of said plurality of cross rails, and wherein an upper surface of said at least one of said plurality of cross rails projects above said upper bracket surface when received in each of said pair of supporting brackets; and a plurality of fasteners respectively received in each of said pair of supporting brackets, wherein each of said plurality of fasteners are in selective anchoring relation with one of said plurality of cross rails upon receipt thereof within one of said plurality of lateral apertures.

2. The shelf assembly of claim 1, wherein said open aperture is an open round aperture.

3. The shelf assembly of claim 1, wherein at least one of said plurality of apertures is a closed aperture, and wherein said closed aperture lies entirely within said supporting bracket.

4. The shelf assembly of claim 1, wherein a threaded hole is formed in each supporting bracket, said threaded hole extending from an opening formed in an aperture wall to an external surface of said supporting bracket, and wherein said fasteners are set screws, said set screws selectively receivable within said threaded holes.

5. The shelf assembly of claim 1, and further comprising a pair of mounting brackets, each of said mounting brackets attached to an end of a separate one of said pair of supporting brackets.

6. A shelf assembled to spaced mounting brackets comprising:

a pair of supporting brackets, each mounted to a separate one of a pair of spaced mounting brackets, each supporting bracket having a plurality of lateral apertures formed therein, said plurality of lateral apertures generally aligned with the plurality of lateral apertures formed in said other one of said supporting brackets to form generally aligned pairs of apertures;

a corresponding number of cross rails extending between and received within each generally aligned pair of apertures, the configuration of said apertures and of said cross rails cooperative to vertically capture said cross rails within said apertures, wherein at least one of said generally aligned pair of apertures comprise a pair of open apertures, each of said pair of open apertures lacking a continuous inner aperture wall, and wherein each of said pair of open apertures is configured to restrain vertical displacement of the cross rail received therein by presenting an opening in an upper bracket surface of said supporting bracket that is smaller than the diameter of the cross rail received therein, and wherein an upper surface of the cross rail received therein projects above said upper bracket surface when received in said generally aligned pair of open apertures; and a plurality of fasteners, at least one of said plurality of fasteners selectively engageable with each of the cross rails in each generally aligned pair of apertures to prevent inadvertent removal of each of the cross rails from said pair of supporting brackets.

7. The shelf assembly of claim 6, wherein at least one of the generally aligned pair of apertures comprises a pair of closed apertures, said closed apertures each lying entirely within said supporting brackets.

8. The shelf assembly of claim 6, wherein each of said plurality of fasteners comprises a set screw.

9. A bracket assembly for shelving comprising:

a supporting bracket having a plurality of lateral apertures formed therein at a plurality of extended locations thereon, each said plurality of lateral apertures configured to accept a cross rail in a manner such that said cross rail is vertically captured within said lateral aperture, wherein at least one of said plurality of lateral apertures is an open aperture lacking a continuous aperture wall, and wherein the open aperture is configured to restrain vertical displacement of the cross rail accepted therein by presenting an opening in an upper bracket surface of said supporting bracket that is smaller than the diameter of the cross rail accepted therein, and wherein an upper surface of the cross rail accepted therein projects above said upper bracket surface of said supporting bracket; and a corresponding number of fasteners selectively engageable with one of the cross rails accepted within each of said plurality of lateral apertures to prevent inadvertent removal of said cross rail.

10. The bracket assembly of claim 9, wherein at least one of said plurality of lateral apertures is a closed aperture, said closed aperture lying entirely within said supporting bracket.

11. The bracket assembly of claim 9, wherein each fastener comprises a set screw.

* * * * *